US006292209B1

(12) United States Patent
Nakamura et al.

(10) Patent No.: US 6,292,209 B1
(45) **Date of Patent: *Sep. 18, 2001**

(54) METHOD OF TESTING LIGHT-EMITTING CONDITION OF VACUUM FLUORESCENT PRINT HEAD

(75) Inventors: Shigetaka Nakamura; Hiromichi Morishima, both of Wakayama (JP)

(73) Assignee: Noritsu Koki Co. LTD, Wakayama-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/217,179

(22) Filed: Dec. 21, 1998

(30) Foreign Application Priority Data

Dec. 26, 1997 (JP) ..... 9-361157

(51) Int. Cl.[7] ..... B41J 2/435
(52) U.S. Cl. ..... 347/236; 347/246; 347/122
(58) Field of Search ..... 347/236, 130, 347/145, 120, 121, 122, 238, 246; 358/518

(56) References Cited

U.S. PATENT DOCUMENTS 5,258,778 * 11/1993 Creutzmann et al. ..... 347/130
5,416,613 5/1995 Rolleston et al. ..... 358/518
5,586,055 12/1996 Ng et al. ..... 346/107.1
5,592,205 1/1997 Shimizu et al. ..... 347/115
5,818,501 * 10/1998 Ng et al. ..... 347/237

FOREIGN PATENT DOCUMENTS 0 713 328 A2 5/1996 (EP) .
0 763 797 A2 3/1997 (EP) .

* cited by examiner

*Primary Examiner*—N. Le
*Assistant Examiner*—Lamson D. Nguyen
(74) *Attorney, Agent, or Firm*—Fulbright & Jaworski, LLP

(57) ABSTRACT

A method of testing light-emitting condition of a vacuum florescent print head is disclosed. The print head is of a type having a plurality of luminous elements disposed along a main scanning direction for forming dots in the form of a linear column on a print paper, and the print head is movable in a sub-scanning direction relative to the print paper. The method includes a first step of exposing and forming on a print paper a plurality of linear dot columns, each column consisting of a plurality of dots arranged along a main scanning direction with a predetermined space therebetween, the plurality of dot columns being juxtaposed with each other with a predetermined space therebetween; a second step of determining density of each dot formed and exposed by the first step one column after another by using a scanner; and a third step of outputting the determined densities of the respective dots as light-emitting amounts of a plurality of luminous elements forming the linear dot column.

2 Claims, 6 Drawing Sheets

METHOD OF TESTING LIGHT-EMITTING CONDITION OF VACUUM FLUORESCENT PRINT HEAD

BACKGROUND OF THE INVENTION

The present invention relates to a method of testing light-emitting condition of a vacuum fluorescent print head. The invention relates more particularly to a method of testing light-emitting condition of a vacuum florescent print head of a type having a plurality of luminous elements disposed along a main scanning direction for forming dots in the form of a linear column on a print paper. For forming a planar image, i.e. an image having both a width and a length, from a plurality of linear dot columns juxtaposed with each other, the print head is movable in a sub-scanning direction relative to the print paper.

DESCRIPTION OF THE RELATED ART

A vacuum florescent print head of the above-noted type is known from e.g. U.S. Pat. Ser. No. 5,592,205. For testing of the light-emitting condition of the print head, the light-emitting amounts of the luminous elements are compared with each other. And, this is done through comparison of densities of the respective dot images obtained therefrom by exposing the dots on the print paper. In doing this, the conventional method is as follows. First, by driving the print head on the print paper along the main scanning direction, there is formed on the print paper a linear dot column, as such shown in FIG. 7-*a,* consisting of a plurality of dots disposed linearly adjacent each other in the main scanning direction. Then, by scanning this dot column by using a line scanner or the like, the densities of the respective dots are obtained and outputted for the subsequent comparison therebetween as the test result of the light-emitting condition of the print head.

The above method has one problem due to the tendency of each dot exposing an area of the print paper greater than the diameter of phosphorous material or phosphor constituting the luminous element forming this dot, resulting in a partial overlap between outermost regions of adjacent dots on the print paper, as illustrated in FIG. 7-*b.* Then, in the subsequent step of obtaining the density of each dot by using a scanner or the like for the purpose of testing the light-emitting condition, each dot will be affected by another dot adjacent thereto. Consequently, the light-emitting condition of each dot, i.e. the luminous element can not be grasped with satisfactory accuracy.

In view of the above-described state of the art, a primary object of the present invention is to overcome the above problem of the conventional method of testing light-emitting condition of a vacuum florescent print head by proposing an improved method which allows an operator to grasp the light-emitting condition of each luminous element with greater accuracy.

SUMMARY OF THE INVENTION

For accomplishing the above-noted object, according to the present invention, in a method of testing light-emitting condition of a vacuum fluorescent print head of the above-noted type, the method comprises:

a first step of exposing and forming on a print paper a plurality of linear dot columns, each column consisting of a plurality of dots arranged along a main scanning direction with a predetermined space therebetween, the plurality of dot columns being juxtaposed with each other with a predetermined space therebetween;

a second step of determining density of each dot formed and exposed by the first step one column after another by using a scanner; and a third step of outputting the determined densities of the respective dots as light-emitting amounts of a plurality of luminous elements forming the linear dot column.

According to the method of the invention having the above-described construction, in each linear dot column formed by the first step, the respective dots belonging in this column are spaced apart from each other in a non-overlapping manner with a predetermined space therebetween, so that the densities of the respective dots may be obtained accurately without mutual interference therebetween. Further, the linear dot columns are spaced apart from each other also in the sub-scanning direction. Hence, in the second step, the scanning operation by the line scanner may be divided into a plurality of scanning operations of the respective columns. Then, with these scanning operations combined, the determination of dot densities may cover the entire dots. As a result, this construction helps to achieve the intended object of the invention, i.e. proposing an improved method which allows an operator to grasp the lightemitting condition of each luminous element with greater accuracy.

According to one preferred embodiment of the present invention, the plurality of dot columns formed in the first step includes a first column obtained by simultaneously exposing all of the luminous elements on the print head that are provided for forming odd-numbered pixels and a second column obtained by simultaneously exposing all of the other luminous elements that are provided for forming even-numbered pixels. With this construction, the entire dots needed for forming the linear dot columns by the luminous elements may be obtained by only two times of exposure operations. As a result, this construction achieves a more efficient method of testing light-emitting condition of a vacuum fluorescent print head.

Further and other features and advantages of this invention will be apparent from the following detailed description of a preferred embodiment thereof in conjunction with accompanying drawings.

DESCRIPTION OF THE PREFERRED EMBODIMENTS

One preferred embodiment of the invention will be described in details with reference to the accompanying drawings.

(Construction of Vacuum Fluorescent Print Head)

Figure 1:
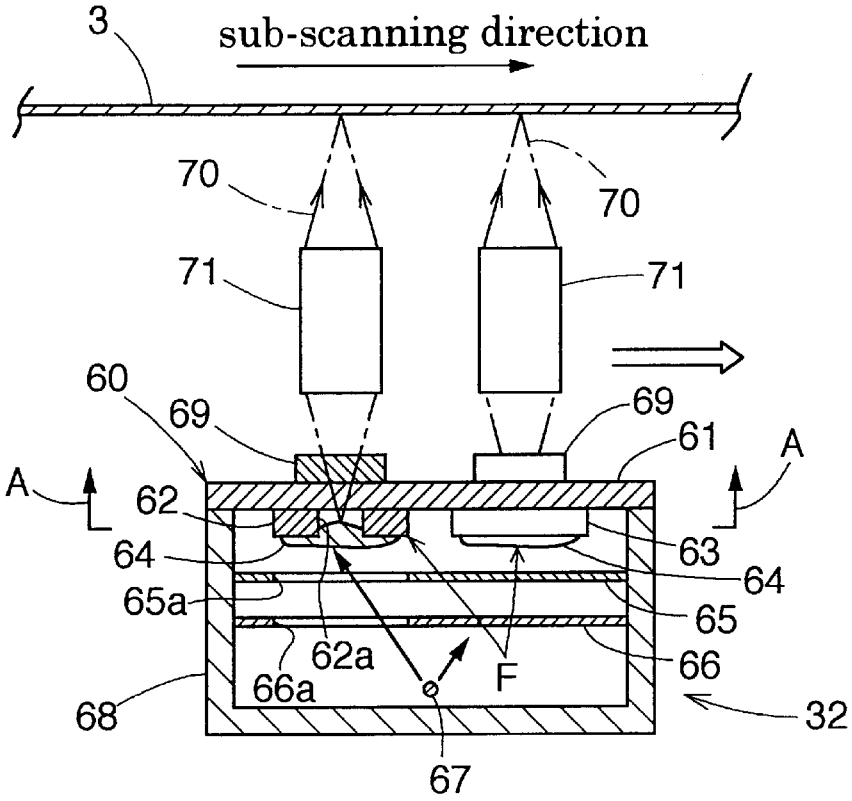
FIG. 1 is a schematic view in section showing the principal portion of a vacuum fluorescent print head incorporated in a printer relating to the present invention.

FIG. 1 is a schematic section showing a vacuum fluorescent print head 60 for color printing used in a printer relating to the present invention. The vacuum fluorescent print head 60 actually includes three luminous blocks 32, 33, 34 (see FIG. 4) for R (red), G (green), and B (blue) components respectively. However, only the R block 32 is shown in FIG. 1. The other G and B blocks are substantially identical in construction to the R block 32.

Figure 2:
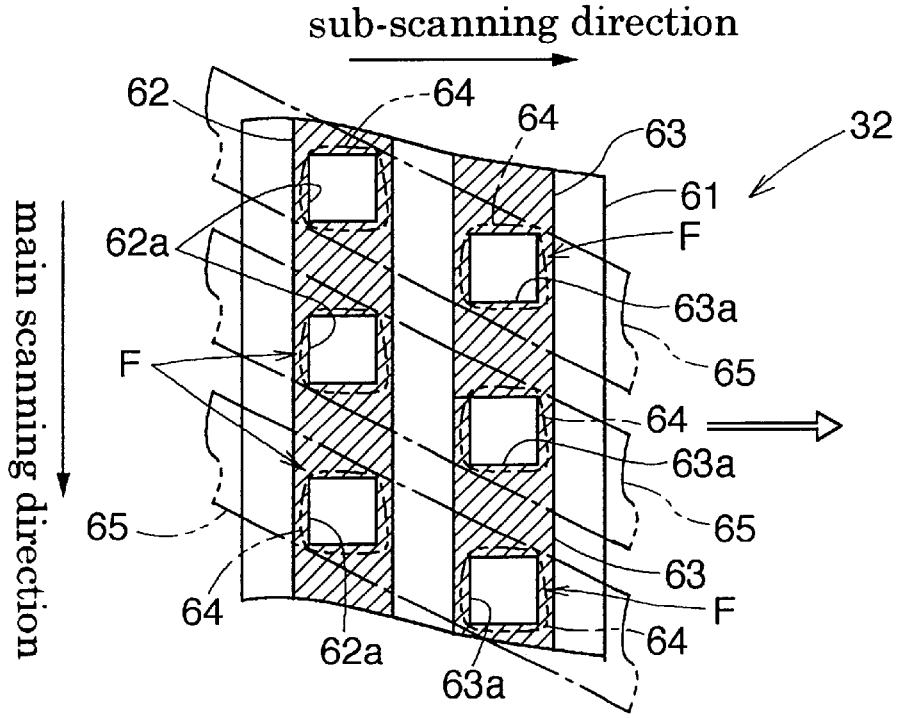
FIG. 2 is an enlarged plan view as seen from a direction of arrow A in FIG. 1.

The luminous block 32 includes a substrate 61 made of a translucent material, on an inner surface of which there are provided a first strip-like anode conductor 62 and a second strip-like anode conductor 63. As may be best understood from FIG. 2, these strip-like anode conductors 62, 63 extend along a main scanning direction which is perpendicular to a transporting direction of a photosensitive material (referred to as a 'print paper' hereinafter) to be exposed by this print head 60. Further, each conductor 62, 63 includes a number of rectangular through-holes 62*a*, 63*a* formed with a predetermined pitch therebetween. And, the through-holes 62*a* of the first strip-like anode conductor 62 and the through-holes 63*a* of the second strip-like anode conductor 63 are arranged in a zigzag pattern relative to each other.

Each of the through-holes 62*a*, 63*a* is covered with a phosphor 64. Spaced apart from and in correspondence with the respective phosphors 64, a plurality of control electrodes 65 are provided to traverse the main scanning direction, each control electrode 65 defining a slit 65*a*, as a translucent portion, in an area thereof opposing the phosphor 64. The respective control electrodes 65 are electrically independent of each other to be impinged with control voltages independent of each other. Farther apart from the control electrodes 65, there is provided an accelerating electrode 66 which comprises a single metal plate defining a plurality of slits 66*a* in correspondence respectively with the slits 65*a* of the control electrodes 65. A common accelerating voltage is impinged on this accelerating electrode 66. Still farther apart from the control electrodes 65, there are provided filamentary cathodes 67 along the main scanning direction. The phosphor 65, the control electrode 65, the first strip-like anode conductor 62 or second strip-like anode conductor 63, and the accelerating electrode 66, together constitute each luminous element F, so that a beam irradiated by each luminous element F forms one-dot latent image on a print paper 3. And, as will be described later, the luminous elements F of the first strip-like anode conductors 62 provide odd pixels of the vacuum fluorescent print head (i.e. the odd-numbered pixels as numbered from the upper end of the head), whereas the luminous elements F of the second strip-like anode conductors 63 provide even pixels of the print head (i.e. the even-numbered pixels as numbered from the upper end of the head).

The above-described components, i.e. the strip-like anode conductors 62, 63, control-electrodes 65, accelerating electrode 66, and the cathode electrode 67 are together accommodated with a vacuum space formed by the inner face of the substrate 61 and a cover 68. On the outer face of the substrate 61, there are attached red color filters 69, as an example of color filter, in opposition to the respective phosphors 64. Then, light beams 70 emitted from the phosphors 64 are modulated through these red color filters 69 and then converged through SELFOC lenses 71 to form an image on the print paper 3.

In operation, with the cathode electrode 67 and the accelerating electrode 66 being impinged with a predetermined voltage, a voltage is impinged alternatively on the first strip-like anode conductor 62 and the second strip-like anode conductor 63 by a predetermined timing and a positive exposure signal is applied to a predetermined control electrode 65, whereby thermion emitted from the cathode electrode 67 is caused to travel through the slit 65*a* depending on the condition of its control electrode 65 and to eventually collide the phosphor 64. Upon impact with this thermion, the excited phosphor 64 emits a light beam 70, which is caused to travel through the through hole to reach the print paper 3 to effect one light beam dot amount of exposure on this paper 3.

The light emitting characteristics of each luminous element F may vary, due to e.g. the light-emitting area, inter-electrode distance, and so on of the element. Then, in order to allow the respective elements F to provide a uniform amount of beam when driven under a same driving condition, the control signal applied to each control electrode 65 is adjusted based on a reference light emission amount value which is obtained in advance through measurements of the elements driven under a certain identical driving condition. With this adjustment, the amounts of beams emitted from the respective luminous elements F may be rendered uniform. The testing method relating to the present invention may be utilized for obtaining the light emission amounts for such adjustment.

(Reciprocating Mechanism for Vacuum Fluorescent Print Head)

Figure 3:
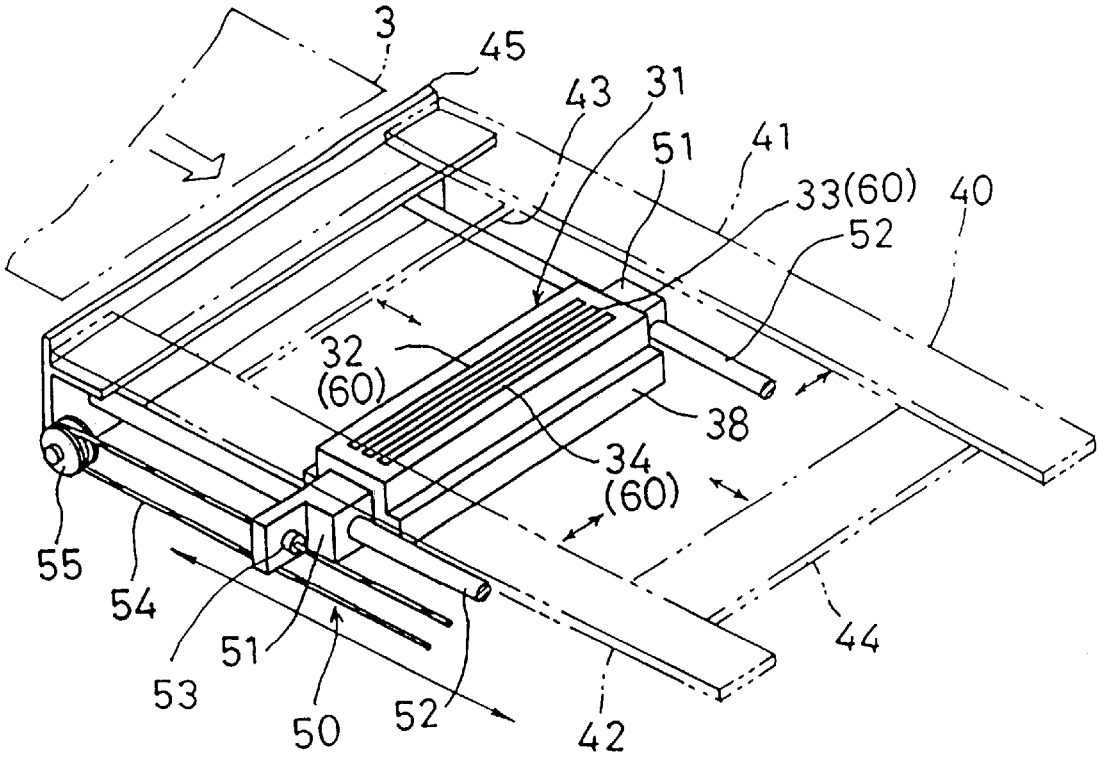
FIG. 3 is schematic perspective view showing the entire print head of FIG. 1.
Figure 11:
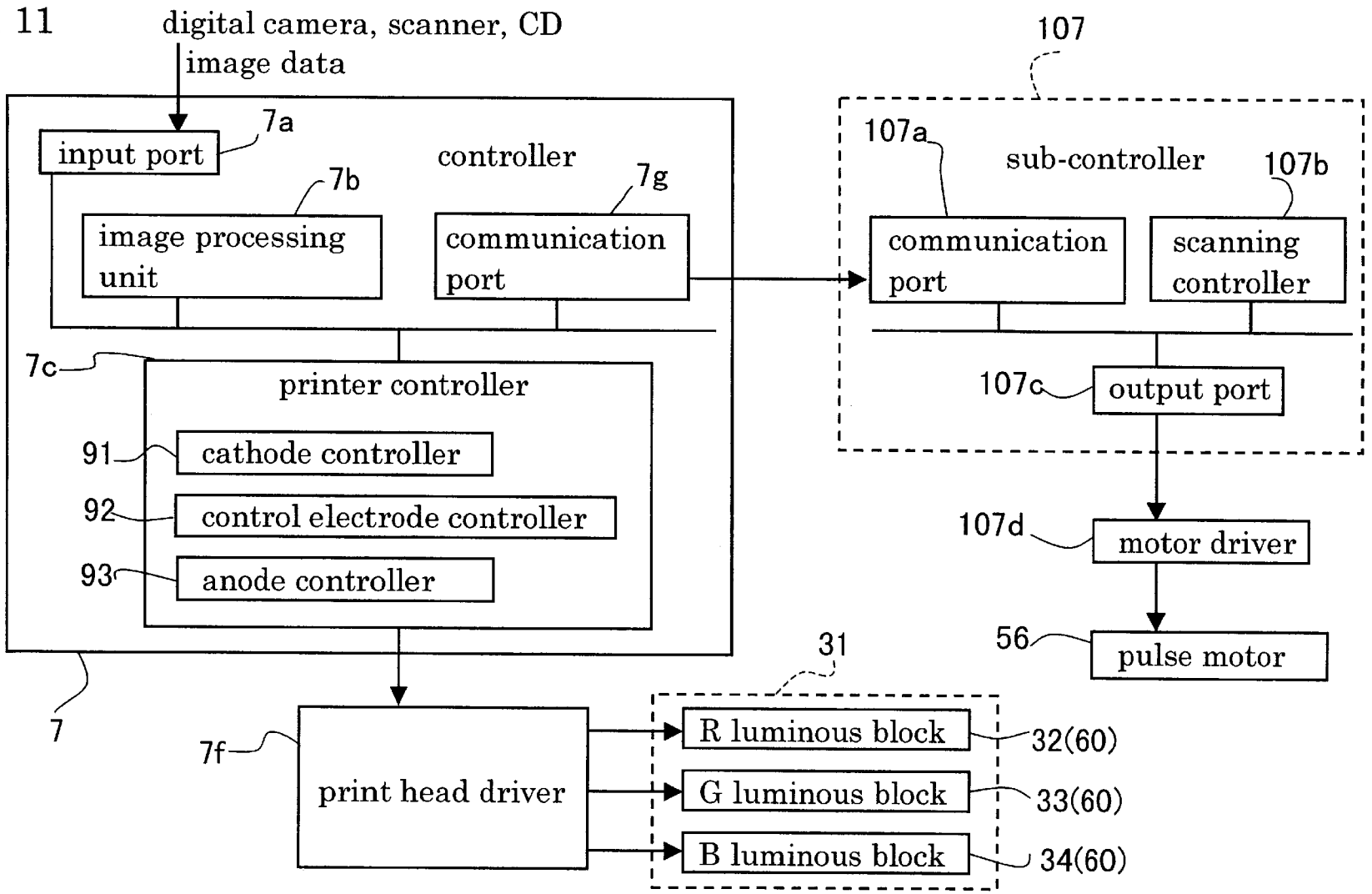
FIG. 11 is a schematic block diagram of a control system relating to the method of the invention for controlling exposure by the print head.

As shown in FIG. 3 in details, a vacuum fluorescent printer 30 includes the print head 60 having the R block 32 having the above-described construction, G block 33 and the B block 34 and also includes a reciprocating mechanism 50 for transporting this print head 60 to scan the print paper 3 along its transporting direction. As shown in FIG. 11, the respective luminous blocks 32, 33, 34 of the print head 60 are connected with a controller 7, and a driver of the reciprocating mechanism 50 is connected to a sub-controller 107. In operation, as the luminous elements F and the reciprocating mechanism 50 are driven under the control of the controller 7, such that under the scanning control in a sub-scanning direction of the print head 60 by the sub-controller 107, image data and/or character data are color-exposed on the print head 3.

Figure 4:
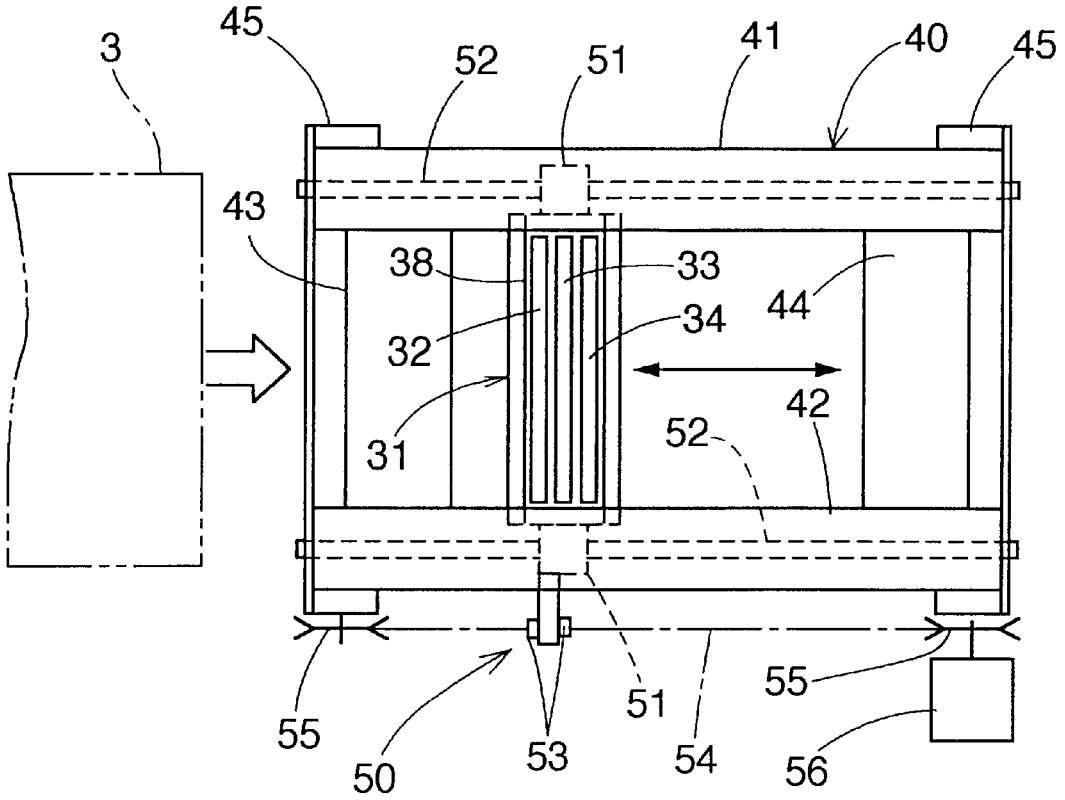
FIG. 4 is a schematic plan view showing a paper mask and a reciprocating for the print head of the printer of FIG. 1.
Figure 5:
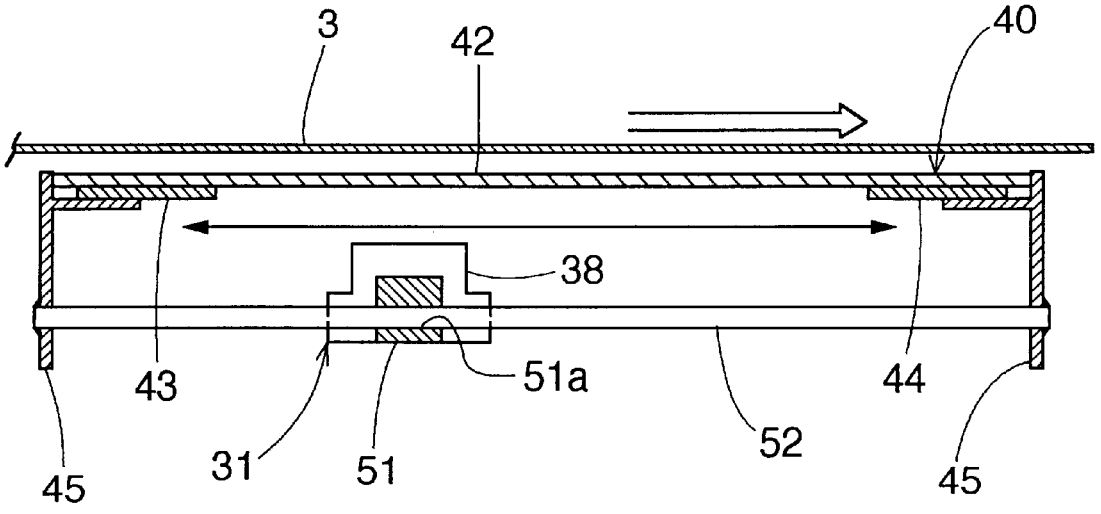
FIG. 5 is a schematic side view showing the paper mask and the reciprocating for the print head of the printer of FIG. 1.

A paper mask 40 has a construction which per se is known in the art and will therefore not be described in details. Referring briefly thereto, however, as schematically shown in FIGS. 4 and 5, the mask 40 includes an upper-side member 41 and a lower-side member 42 which extend parallel with the transporting direction of the print paper 3 and can be moved back and forth in the direction transverse to the transporting direction, a left-side member 43 and a right-side member 44 which extend in the direction transverse to the transporting direction and can be moved back and forth in this transverse direction, and a base frame 45 supporting these upper, lower and side members 41, 42, 43, 44. The distance between the upper-side member 41 and the lower-side member 42 defines the width of the exposed area of the print paper 3, whereas the distance between the left-side member 43 and the right-side member 44 defines the length of the exposed area. The movements of the upper and lower side members 41, 42 and of the left and right side members 43, 44 are controlled by the controller 7 via an unillustrated drive mechanism.

The reciprocating mechanism 50 for the vacuum fluorescent print head 60 is mounted on the base frame 45 of the paper mask 40. This mechanism 50 includes, as major components thereof, a pair of guide members 51 provided at opposed lateral ends of the print head 60, a corresponding pair of guide rails 52 which are inserted respectively in guide holes 51*a* formed in the guide members 51, a wire retainer 53 provided to one guide member 51, a wire 54 having one end thereof secured to the wire retainer 53, a pair of sprockets 55, 55 on which the wire 54 is entrained and which are provided on opposed ends of the base 45, and a pulse motor 56 for rotatably driving the one sprocket 55 under the control of the sub-controller 107. With the rotation of the pulse motor 56, the wire 54 is driven to move the print head 60 along the guide rails 52.

As described hereinbefore, the luminous elements F of the vacuum florescent print head 60 are divided into two columns, i.e. one column of odd-numbered elements and the other column of even-numbered elements. However, in the case of a normal exposure operation based on image information, even all of the odd-numbered and even-numbered phosphors 64 emit respective beams for example, as the print head 60 and the print paper 3 are moved relative to each other in synchronism with a difference between the beam emitting timing of the odd-numbered phosphors 64 and that of the even-numbered phosphors 64, one column of dots, rather than two columns of the same, will be exposed on the print paper 3.

(Testing Method of Light-emitting Condition)

Next, by way of the example of the color-printing vacuum fluorescent print head 60 described above, a method of testing light-emitting condition of the vacuum fluorescent print head relating to one preferred embodiment of the present invention will be described.

Figure 6:
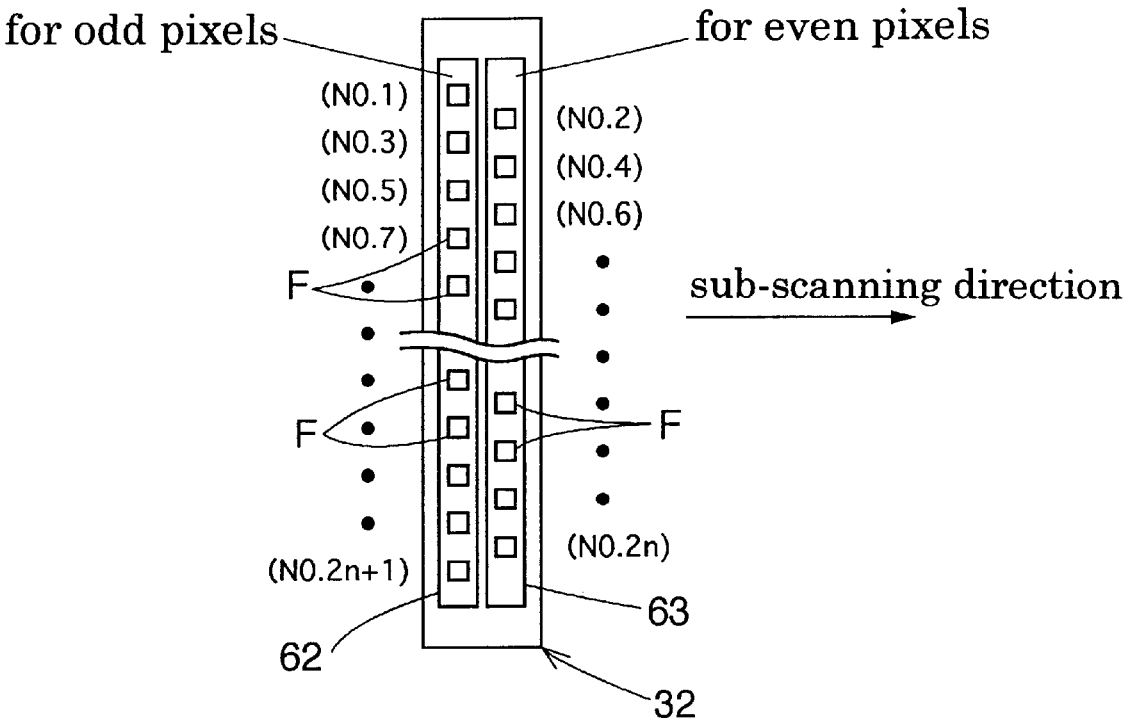
FIG. 6 is a schematic plan view showing one of luminous blocks of the print head shown FIG. 3.

FIG. 6 is a schematic plan view showing the entire R (red) luminous block 32 of the print head 60. As the other two G (green) and B (blue) luminous blocks 33, 34 have the substantially identical construction, the entirely identical method can be applied to these other blocks 33, 34 as well.

As described herein before, the luminous block 32 has the first and second strip-like anode conductors 62, 63 extending along the main scanning direction, and the luminous elements F provided to the first strip-like anode conductor 62 provide the odd pixels of the print head and the elements F of the second strip-like anode conductor 63 provide the even pixels of the same.

Figure 7A:
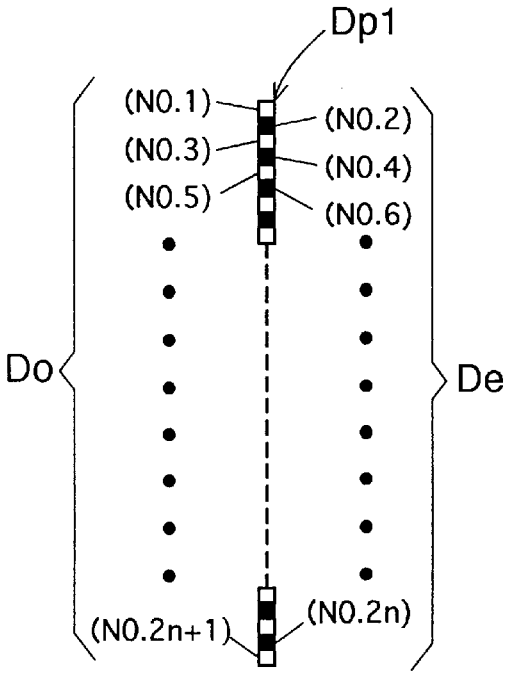
FIG. 7 is a descriptive view illustrating an example of a linear dot column obtained according to a conventional method.
Figure 7B:
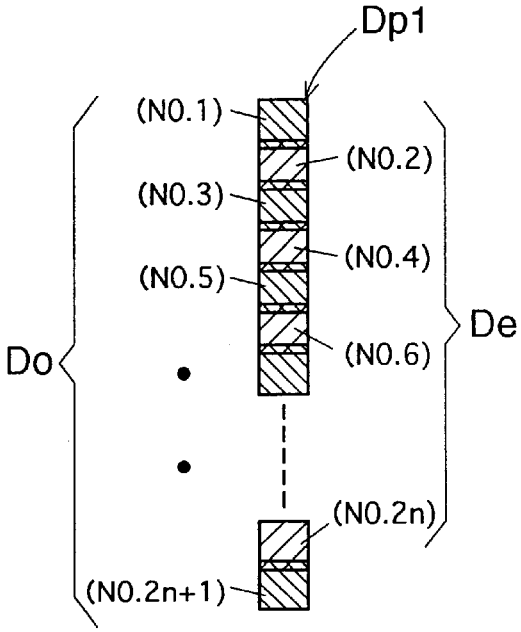

Then, for the purpose of testing the light-emitting condition of the print head 60, all of the odd pixels are exposed by the luminous elements F of the first strip-like anode conductor 62 and all of the even pixels are exposed by the elements F of the second conductor 63, respectively in a manner similar to output of one dot column in the normal exposure operation based on image information. As described hereinbefore, as the print head 60 and the print paper 3 are moved relative to each other in synchronism with the difference between the light-emission timing of the odd-numbered phosphors 64 and that of the even-numbered phosphors 64, the dot column image consisting of the odd pixels and the dot column image consisting of the even pixels will be in complete agreement with each other in the sub-scanning direction on the print paper 3, resulting in formation of a single-column-like dot pattern Dp1 as illustrated in FIG. 7-*a*. When this dot pattern Dp1 is viewed in an enlarged scale, as shown in FIG. 7-*b*, there may be seen partial overlaps between the respective adjacent dots in the outer-most regions thereof (i.e. in the vertical direction in this figure) in the main scanning direction (for instance, the No. 2 dot D is overlapped at the upper end lower ends thereof with the No. 1 dot D and No. 3 dot D, respectively). Therefore, when the density of each dot D is to be read by means of a scanner or the like to check the light-emitting condition of each luminous element, the scanner or the like will read also the portion of the other adjacent dot D, thus making it difficult to grasp accurately the light-emitting condition of each luminous element F.

Then, in view of the above-described problem, in the case of the method of testing light-emitting condition of a vacuum fluorescent print head according to the present invention, for allowing accurate grasp of light-emitting condition of each luminous element F, the test exposure operation is effected in such a manner as to obtain a test dot pattern in which the adjacent dots obtained by the respective luminous elements F will not overlap with each other in the main scanning direction of the print head 60.

Specifically, this method includes the following steps which are to be effected in sequence.

(first step) In this step, a dot pattern consisting of two dot columns is formed on the print paper 3, with the two columns being in spaced juxtaposition to each other in the sub-scanning direction, and each column consisting of dots spaced apart from each other in the main scanning direction. More particularly, this dot pattern is exemplified by a dot pattern Dp2 shown in FIG. 8-*a*. This dot pattern Dp2 (latent image) consists of two columns extending in the main scanning direction, i.e. the first column consisting of the odd-numbered dots Do and the second column consisting of the even-numbered dots De, with the dots Do and De being laid out in a zigzag or staggered pattern. In the instant embodiment, the odd-numbered dots Do (latent images) are exposed and formed on the print paper 3 by the odd pixels of the print head, and the even-numbered dots De (latent images) by the even pixels of the same.

Figure 8A:
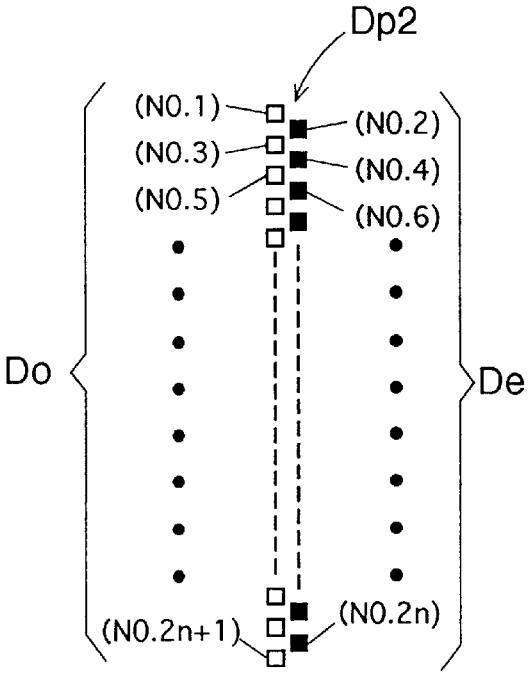
FIG. 8 is a descriptive view illustrating an example of paired linear dot columns obtained according to an improved method proposed by the present invention.
Figure 8B:
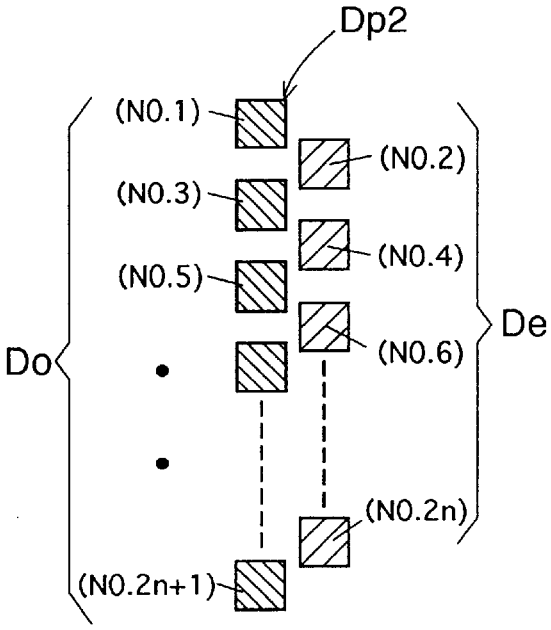

As may be apparent from FIG. 8-*b* which is an enlarged view of a portion of FIG. 8-*a*, the odd-numbered dots Do and the even-numbered dots De are spaced apart from each other (in the right-to-left direction in the figure) by a predetermined space (e.g. 0.1 mm) so as not to overlap with each other. At the same time, overlapping is avoided between the odd-numbered dots Do and so is between the even-numbered dots De (in the vertical direction in the figure). In this embodiment, the latter-mentioned spacing, i.e. "intra-column dot spacing", is automatically realized by the fact that each column consists of dots numbered in the alternate or skipped manner, i.e. consisting of either odd dots alone or even dots alone.

Figure 9:
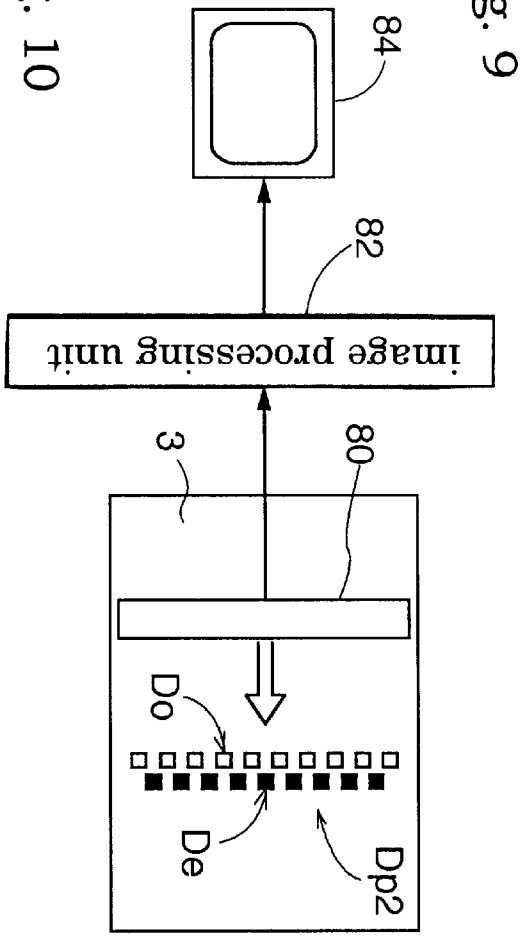
FIG. 9 is a schematic view illustrating a step of reading the dots obtained by Method illustrated in FIG. 8.

(second step) By developing the print paper bearing the latent image, the dot pattern image Dp2 is developed. Then, in the second step, a line scanner 80 or the like is applied to the respective dots of this developed dot pattern Dp2 obtained on the print paper 3 by the first step. More particularly, as shown in FIG. 9, the line scanner 80 is applied to the first dot column consisting of the odd-numbered dots Do so as to obtain the respective densities of these dots Do and then to transmit density signals indicative of the respective densities thus obtained to an image processing unit 82. Thereafter and in succession thereto, the line scanner 80 or the like is applied to the second dot column consisting of the even-numbered dots De so as to obtain the respective densities of these dots De and then to transmit densities signals thereof to the image processing unit 82.

Figure 10:
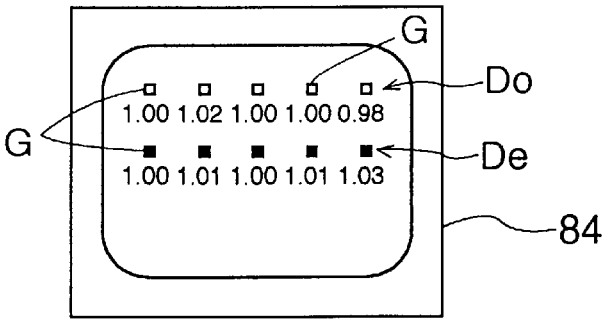
FIG. 10 is a view showing an example of a test result of light-emitting condition obtained by the method of the invention as being outputted and displayed on a monitor screen.

(third step) In this third step, the image processing unit 82 effects conversion of each of the density signals obtained by the measurements in the second step into a numeric ratio value (e.g. '1.00', '1.02' and so on) relative to a predetermined reference value (i.e. '1.00). Then, as illustrated in FIG. 10, a monitor 84 displays, on its screen, these numeric values, as light-emitting amounts of the respective luminous elements F, together with corresponding graphic images G thereof showing the properties of the respective dots in terms of brightness and color thereof. In this screen display, it is proposed that the density information concerning the respective odd-numbered dots Do and that concerning the respective even-numbered dots De be provided separately from each other. However, such separate display between the odd-numbered dots and even-numbered dots is not always needed, as long as it is still possible to identify each piece of density information with one particular dot of certain luminous element. For instance, the information may be displayed based only on the order from the upper end dot of the print head 60.

(Exposure Control of Print Paper by Vacuum Fluorescent Print Head)

FIG. 11 is a schematic block diagram schematically showing the system for controlling the exposure of the print paper 3 by the vacuum fluorescent print head 60. The controller 7 includes an image data input port 7*a* to be connected with an image read device such as a digital camera, scanner, a CD and so on, an image processing unit 7*b* for image-processing inputted image data or bit-mapped character data for generating brightness bit data in the 8 bit format, i.e. 256 steps, and a printer controller 7*c* for setting driving conditions for the print head 60. The printer controller 7*c* includes a cathode control unit 91 for controlling the cathode voltage, a control-electrode control unit 92 for controlling the control voltage, and an anode control unit 93 for controlling the anode voltage.

The anode control unit 93 transmits to the print head driver 71 an impinging-voltage value suitable for the type of the print paper 3 to be printed. Accordingly, the first and second strip-like anode conductors 62, 63 of the respective luminous blocks may be impinged with suitable anode voltages best suited for the particular print paper 3 to be printed.

The control-electrode control unit 92 transmits the image data obtained from the image processing unit 7*b* to the print head driver 7*f*. In this print head driver 7*f*, the brightness value of each color component is converted into a drive-pulse width and then transmitted to the control electrode 65 of each R luminous block 32, G block 33 or B block 34.

The controller 7 also includes a communication port 7*g* connected to a communication port 107*a* of the sub-controller 107. The sub-controller 107 includes a scanning control unit 107*b* for generating control signals relating to the scanning speed and timing of the print head 60, so that the sub-controller 7, in cooperation with the controller 7, transmits the control signals to the pulse motor 56 via an output port 107*c* and a motor driver 107*d*. With this cooperation of the controller 7 and sub-controller 107 an image is printed by the vacuum fluorescent print head 60 at a predetermined position on the print paper 3.

The invention has been described in connection a particular embodiment thereof with the accompanying drawings. It should be noted however, the invention is not to be limited to the specific constructions described in the disclosed embodiment or shown in the drawings, as various modifications thereof will be apparent for one skilled in the art without departing from the essential spirit of the present invention which is defined by the appended claims for a patent application.

What is claimed is:

1. In a method of testing light-emitting condition of a vacuum flourescent print head of a type having a plurality of luminous elements disposed along a main scanning direction for forming dots in the form of a linear column on a print paper, the print head being movable in a subscanning direction relative to the print paper, the method comprising:

a first step of exposing and forming on a print paper a dot pattern comprising a plurality of linear dot columns which are juxtaposed relative to and spaced apart from each other in the sub-scanning direction, each column consisting of a plurality of dots arranged along a main scanning direction with a predetermined space therebetween, the plurality of dot columns being juxtaposed with each other with a predetermined space therebetween;

a second step of determining density of each dot formed and exposed by the first step one column after another by using a scanner; and a third step of outputting the determined densities of the respective dots as light-emitting amounts of a plurality of luminous elements forming the liner dot column.

2. The method according to claim 1, wherein the plurality of linear dot columns formed in the first step includes a first column obtained by simultaneously exposing all of the luminous elements on the print head that are provided for forming odd-numbered pixels and a second column obtained by simultaneously exposing all of the other luminous elements that are provided for forming even-numbered pixels.

* * * * *